United States Patent [19]

Weirich et al.

[11] 4,394,875

[45] Jul. 26, 1983

[54] ACTUATOR FOR A MINE ROOF SUPPORT UNIT

[75] Inventors: Walter Weirich; Werner Grommas, both of Dortmund, Fed. Rep. of Germany

[73] Assignee: Gewerkschaft Eisenhutte Westfalla, Lunen, Fed. Rep. of Germany

[21] Appl. No.: 247,029

[22] Filed: Mar. 24, 1981

[30] Foreign Application Priority Data

Mar. 29, 1980 [DE] Fed. Rep. of Germany ..... 3012291

[51] Int. Cl.[3] ..... F16K 31/52

[52] U.S. Cl. ..... 137/636.1; 74/18.1; 91/170 MP; 91/522; 251/258

[58] Field of Search ..... 137/636, 636.1, 343, 137/356; 251/251, 257, 258; 74/18.1; 91/170 MP, 522, 527, 529, 530; 405/302

[56] References Cited

U.S. PATENT DOCUMENTS

| | | | |
|---|---|---|---|
| 2,317,065 | 4/1943 | Kaelin | 137/636.1 |
| 2,766,772 | 10/1956 | Welty et al. | 251/284 |
| 3,384,121 | 5/1968 | Spencer | 251/284 |
| 3,490,495 | 1/1978 | Green | 137/636.1 |
| 3,557,828 | 1/1971 | Smith | 137/636.1 |
| 3,599,675 | 8/1971 | Sievenpiper | 137/636.1 |
| 4,327,628 | 5/1982 | Weirich et al. | 405/302 |

*Primary Examiner*—George L. Walton

*Attorney, Agent, or Firm*—Sughrue, Mion, Zinn, Macpeak and Seas

[57] ABSTRACT

A hydraulic control system for a mine roof support unit has a control valve assembly for controlling the hydraulic appliances of the unit, and an actuator for actuating the control valve assembly. The actuator has a valve block provided with a plurality of pairs of spool valves. The spool valves of each pair are detachably fixed in a pair of generally parallel bores formed in the valve block. Each pair of spool valves is provided with a respective rocker arm for actuating purposes. Each of the rocker arms is mounted on a respective cover plate, which covers the mouths of the corresponding pair of bores, and which is detachably secured to the valve block.

11 Claims, 3 Drawing Figures

ACTUATOR FOR A MINE ROOF SUPPORT UNIT

BACKGROUND OF THE INVENTION

This invention relates to an actuator for use in the hydraulic control of a mine roof support unit.

A control system for a mine roof support assembly is known in which a respective control valve assembly is associated with each of the roof support units making up the roof support assembly. Each control valve assembly is connected, via a multi-line hydraulic hose, to an actuator having a plurality of pairs of switching valves, there being as many pairs of switching valves as there are control valves in the control valve assembly. The switching valves of each pair are detachably mounted in a pair of generally parallel bores formed in the actuator housing, and are actuable by means of a common rocker arm. By appropriate actuation of the switching valves of a given actuator, the associated control valves can be actuated to control the various operating functions of the corresponding roof support unit (for example to extend or retract the hydraulic props of that unit, or to extend or retract the hydraulic advance ram of that unit). The switching valves of a given actuator are assembled in a common actuator housing which constitutes a valve block. (see DE-OS No. 2700 829).

The aim of the invention is to provide an improved form of actuator of this type.

SUMMARY OF THE INVENTION

The present invention provides an actuator for use in the hydraulic control of a mine roof support unit, the actuator comprising a housing, a pair of valves detachably mounted in a pair of generally parallel bores formed in the housing, and a common rocker arm for actuating the valves, wherein the rocker arm is mounted on a cover plate which covers the mouths of the bores and which is detachably mounted on the housing.

The invention also provides an actuator for use in the hydraulic control of a mine roof support unit, the actuator comprising a housing, a plurality of pairs of valves, and a respective common rocker arm for actuating the valves of each pair of valves, the valves of each pair of valves being detachably mounted in a respective pair of generally parallel bores formed in the housing, wherein each of the rocker arms is mounted on a respective cover plate which covers the mouths of the corresponding bores, and wherein each of the cover plates is detachably mounted on the housing.

This form of actuator is of simple and uniform construction, whilst permitting easy replacement of the valves.

Advantageously, the or each rocker arm is provided with a pair of cams for actuating the pair of associated valves. Preferably, at least one valve is actuated by direct contact with the associated cam of the respective rocker arm.

At least one valve may be provided with a locking member for locking the associated rocker arm in a position in which said valve is actuated, the or each locking member being mounted on the associated cover plate. Preferably, the or each locking member is pivotally mounted on the associated cover plate in such a manner that the associated valve is actuated by one of the cams of the associated rocker arm via the locking member, the locking member and said one cam being provided with mutually engageable clamping faces for locking that rocker arm in the position in which said valve is actuated.

In a preferred embodiment, the or each rocker arm is provided with means for biasing that rocker arm into a position in which neither of the associated valves is actuated. Thus, where a given valve is not provided with a locking member, the associated rocker arm is automatically returned to its "neutral" position (that is to say the position in which neither of the associated valves is actuated) when released by the operator. This gives rise to what is known as a "dead-man's" switching action. Obviously, as each of the rocker arms is a component of one of the cover plates, and each valve can be actuated either directly or via a locking member, it is possible to provide an actuator whose pairs of valves have different combinations of switching actions. For example, at least one of the rocker arms may be such that both its valves are actuated by a dead-man's switching action. Alternatively, it is advantageous, in many cases, for at least one rocker arm to have one valve actuable with a dead-man's switching action, and to have its other valve provided with a locking member for holding that valve in the actuated position once the operator has released the rocker arm. It is also possible for both the valves associated with a given rocker arm to be provided with locking members. These different combinations are readily achieved by appropriate selection of cams and locking members for the different cover plates. A dead-man's switching action is required where the control valve being actuated controls the extension and retraction of the hydraulic props of a mine roof support unit. However, a dead-man's switching action is not desirable for other operations, such as extending or retracting hydraulic advance or alignment rams.

Advantageously, a sleeve is detachably mounted on the housing, the sleeve being made of resilient material and extending away from the housing so as to provide a protective surrounding for the rocker arms. Preferably, the sleeve is made of rubber. Conveniently, a resilient protective bellows is arranged on, and extends across, the sleeve, the rocker arms passing through respective apertures in the bellows which thereby constitutes said biasing means.

Each valve may be a spool valve having a stem which is engageable by the associated rocker arm for actuating that valve. Advantageously, each spool valve is of stepped construction, having successive portions of reduced diameter, the largest diameter portion being adjacent to the associated cover plate, and each bore is of complementary stepped construction to its spool valve. Preferably, each spool valve is formed with peripheral annular grooves at its stepped portions, and wherein the annular grooves are provided with O-rings.

Advantageously, each valve is provided with a hexagonal, spanner-engageable portion at that end adjacent to the associated cover plate, and with a screw-threaded portion adjacent the other end thereof, the screw-threaded portion being engageable with a complementary screw thread formed in the associated bore. Preferably, the hexagonal portion of each valve is accommodated in a respective recess formed in the associated cover plate.

BRIEF DESCRIPTION OF DRAWINGS

An actuator constructed in accordance with the invention will now be described, by way of example, with reference to the accompanying drawings, in which.

DESCRIPTION OF PREFERRED EMBODIMENT

Figure 1:
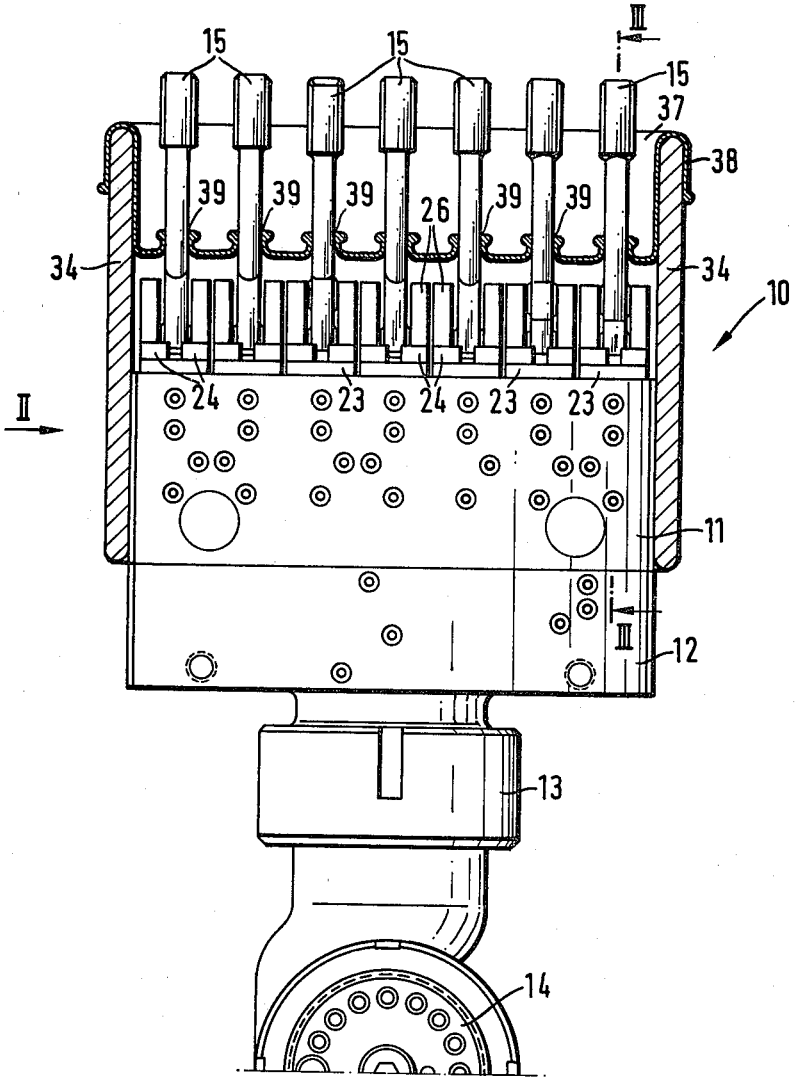
FIG. 1 is a part-sectional side elevation of the actuator, and shows part of an associated hydraulic control system for a mine roof support assembly.

Referring to the drawings, FIG. 1 shows an actuator 10 which forms part of a hydraulic control system for a mine roof support assembly. The actuator 10 includes a valve block 11 attached to a distributor plate 12. A hydraulic coupling device 14 is connected to the distributor plate 12 by means of a pivotable coupling 13. The coupling device 14 is connected, by means of a multi-line hose (not shown) to a control valve assembly (not shown). The control valve assembly comprises a plurality of control valves for controlling the hydraulic working units (such as rams and props) of a hydraulic roof support unit (not shown). The actuator 10 has a plurality of switching valves 17 (to be described below) which serve to actuate the control valves of the control valve assembly. The multi-line hose has a plurality of hydraulic conduits bunched together within a protective sleeve. Each of the conduits is associated with a respective control valve, and is supplied with pressurised hydraulic fluid via a respective switching valve, respective internal ducts formed within the valve block 11 and the distributor plate 12, and the coupling device 14.

The valve block 11 is provided with seven pairs of switching valves 17, the valves of each pair being manually actuable by means of a common rocker arm 15. The valve block 11 thus has fourteen parallel bores 16 (see FIG. 3), each of which houses a respective switching valve 17. Each of the switching valves 17 is preferably constituted by a spool valve. The bores 16 are arranged within the valve block 11 in two rows of seven, each of the bores passing right through the valve block.

The valves 17 are introduced into their bores 16 from the ends at which the rocker arms 15 are situated. At that end of the valve block 11, each of the valves 17 has a stem 18. The opposite end of each valve 17 has a threaded portion 19, by means of which it can be screwed into a complementary thread formed within the corresponding bore 16. Each of the valves 17 is of stepped construction, having portions of different diameters; the largest diameter portion being adjacent to the stem 18, and the smallest diameter portion being adjacent to the threaded end portion 19. Annular grooves are formed at the stepped portions, O-rings 20 being fitted into these annular grooves. The O-rings 20 serve to seal the valves 17 with respect to their bores 16. The bores 16 are also stepped so as to match the valves 17. This stepped construction of the bores 16 and the valves 17 facilitates the processes of inserting the valves into the bores, and of removing the valves from the bores. Moreover, this arrangement prevents the O-rings 20 from being damaged by contact with the bore walls and the stepped portions, when the valves 17 are inserted or withdrawn.

Between its stem 18 and the adjacent large diameter portion, each valve 17 has a hexagonal portion 21, which can be engaged by a spanner for screwing the threaded portion 19 of that valve into, or out of, engagement with the complementary thread of the associated bore 16. The hexagonal portion 21 is located outside the bore 16 in a recess 22 formed in the lower side of a cover plate 23. There are seven cover plates 23, each of which is associated with a pair of valves 17. Each cover plate 23 is detachably mounted, by means of screw-threaded members 24, to the valve block 11 so as to cover the bores 16 of the associated pair of valves 17. The stems 18 of the valves 17 extend through apertures in the hexagonal portions 21, and through apertures 25 in the cover plates 23.

Figure 3:
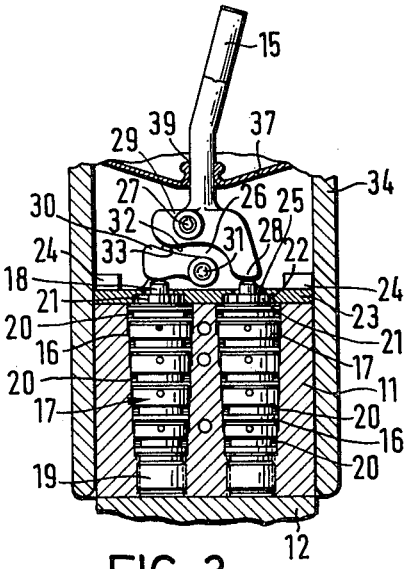
FIG. 3 is a cross-section taken on the line III—III of FIG. 1.

As shown in FIG. 3, each of the rocker arms 15 is pivotally mounted, about a pivot pin 27, on a bifurcated holder 26 attached to the respective cover plate 23. The axis of each of the pivot pins 27 extends at right-angles to the axes of the associated pair of bores 16, and is off-set (towards the left as seen in FIG. 3) with respect to the vertical longitudinal central plane of the valve block 11. The rocker arm 15 shown in FIG. 3 has a switching cam 28, which acts directly on the stem 18 of one of the associated valves 17 (the right-hand valve as seen in FIG. 3). This rocker arm 15 has a second switching cam 29 which acts indirectly (by way of a locking member 30) on the stem 18 of the other valve 17 of the associated pair. The locking member 30 is pivotally mounted, about a pivot pin 31, on the holder 26. The pivot pin 31 is parallel to the pivot pin 27 of that rocker arm 15. The switching cam 29 and the locking member 30 have mutually cooperating clamping faces 32 and 33 respectively. These clamping faces 32 and 33 are such that, once the rocker arm 15 has been pivoted to the left (as seen in FIG. 3) so as to actuate the left-hand valve 17 via the locking member 30, the rocker arm is held in that position by the engagement of the clamping faces. In order to restore the rocker arm 15 to its initial, central position (that is to say the position shown in FIG. 3), it must be manually returned.

The other valve 17 associated with the rocker arm 15 shown in FIG. 3 is actuated directly by the cam 28. Here, what is known as a dead-man's switching action is achieved since, when the rocker arm 15 is released, it is returned automatically to its initial central position by means of a spring device to be described below. The other six rocker arms 15 may be provided with switching cams 28 and 29, and locking members 30, so that each pair of valves 17 has one valve which can be locked in the actuated position without having to be manually held, and one valve which automatically returns to its non-actuated position when the manual force holding the associated rocker arm is released. Alternatively, one or more of the rocker arms 15 may have two switching cams 28, and/or one or more of the rocker arms may have two switching cams 29 and two locking members 30.

Figure 2:
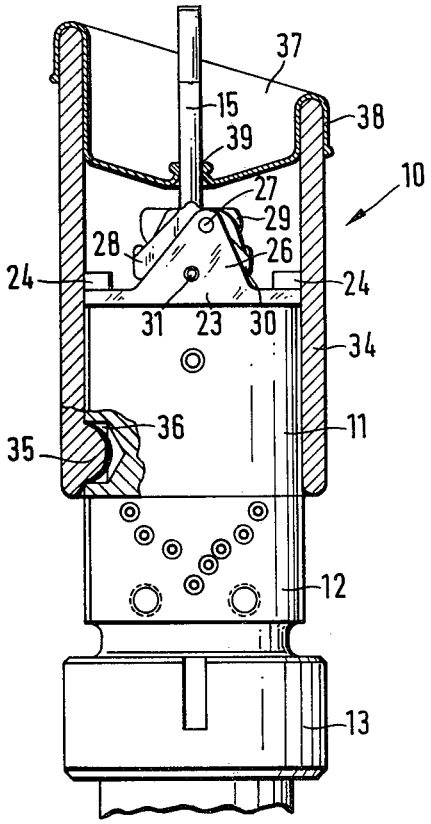
FIG. 2 is an end elevation, partially broken away, of the actuator as seen looking in the direction of the arrow II.

The valve block 11 is provided with a resilient cap or sleeve 34. The sleeve 34, which may be made of rubber, projects upwardly beyond the valve block 11 to accommodate the rocker arms 15. The sleeve 34 thus protects the rocker arms 15 against damage, and prevents unintentional actuation. As shown in FIG. 2, the sleeve 34 is releasably attached to the valve block 11 by means of ribs 35 which engage in complementary recesses 36 in the valve block.

At its top, the sleeve 34 is provided with a protective bellows 37 made of rubber or similar resilient material. The bellows 37 has a collar 38 which engages over the upper edge of the sleeve 34. The bellows 37 has a respective aperture 39 for each of the rocker arms 15, the rocker arms passing through these apertures so as to be accessible to an operator. The bellows 37 serves to keep out dust, and it also serves as the spring device for returning one or more of the rocker arms 15 to the initial, central position in the case of dead-man's switching.

In order to replace a given valve 17, it is necessary only to remove the associated cover plate 23 by extracting the screw-threaded members 24, after which the valve can be unscrewed from its bore 16 with the aid of a spanner applied to its hexagonal portion 21.

The entire actuator 10 is made from a small number of standard parts, so that it is relatively cheap. Moreover, only the cover plate 23 (together with their rocker arms 15 and associated cams 28 and/or 29) need to be attached to the valve block 11 in order to actuate the valves 17, so that the actuator 10 is relatively simple to assemble. Furthermore, each of the valves 17 can be arranged to have a dead-man's switching action or an automatic return action in a simple manner, so that the actuator 10 is extremely versatile. Consequently, the control valves of the associated control valve assembly can be controlled by the actuator 10 in any required manner.

The spool valves 17 are preferably of the same type as that described in the patent specification of copending U.S. Patent Application Ser. No. 162,546.

We claim:

1. An actuator for use in the hydraulic control of a mine roof support unit, the actuator comprising a housing, a plurality of pairs of valves, and a respective common rocker arm for actuating the valves of each pair of valves, the valves of each pair of valves being detachably mounted in a respective pair of generally parallel bores formed in the housing, each of the rocker arms being mounted on a respective cover plate which covers the mouths of the corresponding bores, and each of the cover plates being detachably mounted on the housing, wherein a sleeve is detachably mounted on the housing, the sleeve being made of resilient material and extending away from the housing to provide a protective surrounding for the rocker arms, and wherein a resilient protective bellows is arranged on, and extends across, the sleeve, the rocker arms passing through respective apertures in the bellows which thereby conprises means for biasing each of the rocker arms into a position in which neither of the associated valves is actuated.

2. An actuator according to claim 1, wherein each rocker arm is provided with a pair of cams for actuating the pair of associated valves.

3. An actuator according to claim 2, wherein at least one valve is actuated by direct contact with the associated cam of the respective rocker arm.

4. An actuator according to claim 3, wherein at least one valve is provided with a locking member for locking the associated rocker arm in a position in which said valve is actuated, said at least one locking member being mounted on the associated cover plate.

5. An actuator according to claim 4, wherein said at least one locking member is pivotally mounted on the associated cover plate in such a manner that the associated valve is actuated by one of the cams of the associated rocker arm via the locking member, the locking member and said one cam being provided with mutually engageable clamping faces for locking that rocker arm in the position in which said valve is actuated.

6. An actuator according to claim 1, wherein each valve is a spool valve having a stem which is engageable by the associated rocker arm for actuating that valve.

7. An actuator according to claim 6, wherein each spool valve is of stepped construction, having successive portions of reduced diameter, the largest diameter portion being adjacent to the associated cover plate.

8. An actuator according to claim 7, wherein each bore is of complementary stepped construction to its spool valve.

9. An actuator according to claim 7, wherein each spool valve is formed with peripheral annular grooves at its stepped portions, and wherein the annular grooves are provided with O-rings.

10. An actuator according to claim 1, wherein each valve is provided with a hexagonal, spanner-engageable portion at that end adjacent to the associated cover plate, and with a screw-threaded portion adjacent the other end thereof, the screw-threaded portion being engageable with a complementary screw thread formed in the associated bore.

11. An actuator according to claim 10, wherein the hexagonal portion of each valve is accommodated in a respective recess formed in the associated cover plate.

* * * * *